US009590350B2

(12) United States Patent
Plant et al.

(10) Patent No.: US 9,590,350 B2
(45) Date of Patent: Mar. 7, 2017

(54) UNDERWATER CONNECTING APPARATUS AND ASSEMBLIES

(71) Applicant: SIEMENS AKTIENGESELLSCHAFT, München (DE)

(72) Inventors: Christopher Plant, Lancaster (GB); Mark Simmonds, Ulverston (GB); Stephen Ward, Ulverston (GB)

(73) Assignee: Siemens Aktiengesellschaft, München (DE)

( * ) Notice: Subject to any disclaimer, the term of this patent is extended or adjusted under 35 U.S.C. 154(b) by 92 days.

(21) Appl. No.: 14/421,677

(22) PCT Filed: Jul. 29, 2013

(86) PCT No.: PCT/EP2013/065927
§ 371 (c)(1),
(2) Date: Feb. 13, 2015

(87) PCT Pub. No.: WO2014/032884
PCT Pub. Date: Mar. 6, 2014

(65) Prior Publication Data

US 2015/0207265 A1 Jul. 23, 2015

Related U.S. Application Data

(60) Provisional application No. 61/694,847, filed on Aug. 30, 2012.

(30) Foreign Application Priority Data

Aug. 30, 2012 (GB) ..... 1215456.3

(51) Int. Cl.
*H01R 13/52* (2006.01)
*H01R 13/523* (2006.01)

(52) U.S. Cl.
CPC ..... *H01R 13/523* (2013.01)

(58) Field of Classification Search
CPC .... H01R 13/005; H01R 13/523; H01R 23/10; H01R 13/533; H01R 13/53; H01R 4/60;
(Continued)

(56) References Cited

U.S. PATENT DOCUMENTS 4,778,402 A 10/1988 Schoepf
4,854,886 A 8/1989 Neuroth
(Continued)

FOREIGN PATENT DOCUMENTS

GB 2192316 1/1988
WO WO2008/113026 A1 9/2008

OTHER PUBLICATIONS

National Search report GB1215456.3, Dec. 31, 2012, pp. 1-3, GB.
International Search Report and Written Opinion cited in PCT/EP2013/065927, mailed Sep. 6, 2013.

*Primary Examiner* — Xuong Chung Trans
(74) *Attorney, Agent, or Firm* — Lempia Summerfield Katz LLC

(57) ABSTRACT

An underwater connecting apparatus is provided. The underwater connecting apparatus includes a flexible diaphragm defining a wall of a chamber for receiving therein an electrical conductor and for containing an electrically insulating material around the conductor. The flexible diaphragm includes an electrically conductive material.

16 Claims, 6 Drawing Sheets

(58) Field of Classification Search
CPC .. H01R 4/64; H01R 13/5219; H01R 13/5202; H01R 13/5216; H01R 9/11; H01R 13/20
See application file for complete search history.

(56) References Cited

U.S. PATENT DOCUMENTS

| | | | | |
|---|---|---|---|---|
| 6,315,461 | B1 * | 11/2001 | Cairns ..... | G02B 6/3816 385/139 |
| 7,959,454 | B2 * | 6/2011 | Ramasubramanian | H01R 13/03 439/201 |
| 2006/0128196 | A1 | 6/2006 | McKinnon | |
| 2009/0197447 | A1 | 8/2009 | Maeland | |

* cited by examiner

UNDERWATER CONNECTING APPARATUS AND ASSEMBLIES

CROSS-REFERENCE TO RELATED APPLICATIONS

The present patent document is a §371 nationalization of PCT Application Serial Number PCT/EP2013/065927, filed Jul. 29, 2013, designating the United States, which is hereby incorporated by reference, and this patent document also claims the benefit of GB 1215456.3, filed on Aug. 30, 2012, and U.S. Provisional Application No. 61/694,847, filed Aug. 30, 2012, which are also hereby incorporated by reference.

TECHNICAL FIELD

The embodiments relate to underwater cable termination apparatus and assemblies and to underwater connecting apparatus and assemblies.

BACKGROUND

It is known to terminate an underwater cable to a bulkhead of a subsea installation, to the back end of an underwater connector, or to a harness that provides an intermediate unit between a cable and another cable or subsea installation or connector. In certain known cable termination assemblies, a seal is formed at the rear of a cable termination chamber housing to seal against the cable jacket and thereby separate the interior of the housing from either ambient water to the rear thereof or from oil contained in a hose accommodating the cable. The seal is formed by a relatively hard plastic cone having an aperture through which the cable jacket extends and a radially inwardly facing surface for sealing against the jacket. The cone has a radially outwardly facing conical surface engaged by a radially inwardly facing conical surface of a seal energising member. The seal energising member is urged axially towards the cone member so as to compress it radially inwardly and form a seal with the cable jacket.

Another type of sealing arrangement known for use in cable termination assemblies provides a seal between axially adjacent chambers into which the cable extends. Each chamber contains a fluid such as oil or gel and is pressure balanced with respect to outside pressure by having a flexible wall the outside of which is exposed directly or indirectly to the outside environment. In order to separate the fluid in the two chambers a pair of back to back seals is provided. The cable passes through an aperture in a hard plastic seal holder and at each axially opposite side of the seal holder a first part of a respective elastomeric seal member engages round and seals against the cable jacket and a second part of the seal member engages round and seals against an axial extension of the seal holder.

SUMMARY AND DESCRIPTION

The scope of the present invention is defined solely by the appended claims and is not affected to any degree by the statements within this summary. The present embodiments may obviate one or more of the drawbacks or limitations in the related art.

In a first aspect, a cable termination apparatus and assemblies are provided for an underwater cable with an improved sealing arrangement for a chamber of a cable termination housing.

Viewed from a first aspect, the cable termination apparatus for an underwater cable includes: a cable termination housing having a chamber into which in use a cable is to extend; and an annular seal member that in use is to engage in sealing manner with a cable in order to seal between the chamber and a region outside of the chamber, the annular seal member including a first annularly and axially extending portion that in use is to engage the cable and to extend axially along the cable inwardly into the chamber, the first portion being exposed to pressure in the chamber, and a second annularly and axially extending portion that in use is to engage the cable and to extend axially along the cable away from the chamber, the second portion being exposed to pressure in the region outside the chamber.

In use, the first portion is exposed to the pressure inside the chamber of the cable termination housing, and the second portion is exposed to pressure in the region outside the chamber, which may be that of ambient water, of an adjacent chamber, or fluid provided in a hose that accommodates the cable. In each case, the pressure may urge the respective annularly and axially extending portion against the cable to seal thereagainst.

In the known cone sealing arrangement discussed above, a good seal is obtained by energising the cone member and compressing it radially inwardly onto the cable jacket. However, this may give rise to a problem that the jacket may soften as a result of a phenomenon known as "compression set", with a resulting loss of seal integrity over time. The sealing provided by the annular seal member of the first aspect may impose a relatively low radial load on the cable jacket and thus reduce the risk of seal effectiveness being compromised by compression set.

In the known back to back sealing arrangement discussed above, when the assembly is used at depth the pressure in the chambers on each side of the sealing arrangement balances to the increased external pressure. Since however the seal support is assembled onto the cable jacket at atmospheric pressure, there may be a tendency, as the pressure in the chambers increases, for each elastomeric seal to be pushed under the seal holder by the pressure differential, forcing itself between the cable jacket and the seal holder. This may break the seal between the two chambers, with the result that if there is any leakage of water into the outer of the two chambers (e.g., due to loss of integrity of the seal between that chamber and ambient) the water may also pass into the inner of the chambers. By using a sealing arrangement in accordance with the first aspect, it is possible to avoid the use of a seal holder between two back to back seals.

The underwater cable termination apparatus may be configured for electrical signal or data transmission. It may be configured to handle relatively low voltages, such as a peak or maximum of 1 kV or less. The underwater cable termination apparatus may be configured for electrical power transmission. It may be configured to handle alternating root mean square (RMS) voltages up to 5 or 10 or 20 or 30 or 40 or 50 or 60 or 70 or 80 or 90 or 100 or 110 or 120 or 130 or 140 kV or above. The underwater cable termination apparatus may be configured for optical transmission, for example, via optical fibers. The cable may contain optical fibers and/or electrical conductors.

The annular seal member may be a one piece seal member.

In use, the annular seal member may be to engage in sealing manner with a jacket of a cable.

The first and second axially extending portions each may have a diameter that, in an unstressed condition of the respective portions, is smaller than the diameter of the, e.g., cable jacket with which they are to engage in use. The first and second axially extending portions may therefore be stretched in the circumferential direction when the annular seal member is deployed on the cable. The amount of stretching, and the resulting radial inward force on the cable, is selected to minimize the tendency for the annular seal member to cause compression set of the e.g. cable jacket. The stretching arrangement avoids the need for any other mechanical component to effect sealing onto the cable. The respective pressures inside and outside of the chamber, (for example, that of gel, oil or water, on the first and second axially extending portions), may contribute to sealing effectiveness.

The respective lengths of the first and second portions in the axial direction may be selected to spread the radially inward stress on the cable as needed. The length of the first portion or the second portion may be at least 2 or 4 or 6 or 8 or 10 or 15 or 20 or 25 or 30 or 35 or 40 mm.

The first and second portions may be thin as measured in a radial direction. This provides that they may be deformable and make good sealing contact with the cable and may do so without too much radially inward stress on the cable.

The thickness of the first and/or second portion, considered at a position where they extend axially away from each other, may be less than 5 or 4 or 3 or 2 or 1 mm. If an intermediate annularly extending portion, as discussed below, is provided, the thickness of the first and/or second portion, as measured in a radial direction and considered at a region where the respective portion joins the intermediate portion, may be less than the thickness of the intermediate portion, as measured in the axial direction of the cable.

The first portion may have a radially outwardly facing surface arranged to be exposed to pressure in the chamber. The second portion may have a radially outwardly facing surface arranged to be exposed to pressure in the region outside of the chamber. The annular seal member may include an intermediate annularly extending portion, located intermediate of the first and second portions, the intermediate portion being arranged to be exposed on one axial side thereof to pressure in the chamber and exposed on an opposite axial side thereof to pressure in the region outside the chamber. The intermediate portion may extend radially outwardly of the first and second portions. It may extend radially outwardly in a direction normal to the axial direction, or it may extend radially outwardly in a direction having both a component normal to the axial direction and a component in the axial direction. The intermediate portion may form a wall of the chamber, for example, an axial end wall.

The annular seal member may have an annularly extending part arranged to be sealed with respect to a wall of the housing. The annularly extending part may be in the form of a bead or lip or the like. It may be longer in the axial direction than in the radial direction. The annularly extending part may be at a location that is radially outwardly spaced from the radial location of the first and second portions. It may be located radially outwardly of the first annularly and axially extending portion, or radially outwardly of the second annularly and axially extending portion, or radially outwardly of a position from which the first and second portions extend axially away from each other.

The annularly extending part may be gripped in a recess. This may provide an effective sealing between the annular seal member and the housing wall. In certain embodiments, the recess is generally T-shaped when viewed in axial cross-section. The annularly extending part may be gripped by being compressed in the axial direction.

The annularly extending part may be gripped between a pair of ring members. The ring members may be respective parts of a seal holder. The ring members may together form the recess in which the annularly extending part is gripped. The ring members may be urged together in the axial direction, for example, by a locking ring.

The annularly extending part may seal directly to the housing wall. In some embodiments, it is sealed to a seal holder that in turn is sealed to the housing wall. If a seal holder is provided in two parts one part may be integral with the wall of the housing, but both parts may be provided separately. A first seal holder part may be secured to the wall of the housing in sealed manner, for example, by being screwed into place. A screw thread may be provided around the outer circumference of the first seal holder part, and a corresponding screw thread may be provided around an inner peripheral surface of the housing wall. The seal holder part may be arranged to be urged axially against a shoulder in the housing wall. An annular seal, such as an O-ring or the like, may be provided to act between the shoulder and the seal holder part.

A second seal holder part may be arranged to be urged axially towards the first seal holder part, e.g. by the locking ring mentioned above. The first and second seal holder parts may be arranged to compress the annularly extending part when the second seal holder part is urged towards the first seal holder part.

The annular seal member may be part of an axially extending flexible diaphragm that includes an axially extending wall of the chamber. The wall may be at a radially outer position compared to the radial positions of the first and second annularly and axially extending portions. The wall may be substantially cylindrical or it may be substantially conical.

In one apparatus, the pressure in the termination housing chamber is balanced to external pressure by a suitable arrangement, such as a flexible diaphragm forming a wall of the chamber. The flexible diaphragm may be a separate component from the annular seal member, or it may be provided as part of the same component, as mentioned above. The pressure in the region outside the chamber may be that of ambient water, that in an adjacent chamber, or that in a hose that accommodates the cable. In the cases of an adjacent chamber or a hose, the pressure therein may be pressure balanced to ambient conditions. Thus the annular seal member may have to cope with little or no pressure difference between the chamber and the region that it separates. It may thus form a good seal between the termination housing chamber and the region on the other axial side of the seal member by the pressure acting on the respective axially extending portions.

The cable termination housing may have another chamber into which in use the cable is to extend, and wherein the annular seal member is arranged to seal between the first mentioned chamber and the other chamber. The other chamber may be pressure balanced to external pressure, for example, by having a flexible diaphragm forming a wall of the other chamber.

In certain embodiments of the apparatus, the chamber, or each chamber, is filled with fluid, such as oil or gel.

The embodiments also provide a cable termination assembly including apparatus as discussed herein, and the cable that extends into the chamber, or each chamber.

The first and second axially extending portions of the annular seal member may each have a diameter that, in an unstressed condition of the respective portions, is smaller than the diameter of the cable, for example, the cable jacket, with which they engage. In a second aspect, an underwater connecting apparatus is provided with an improved flexible diaphragm that defines a wall of a chamber filled with fill material.

It is known to provide underwater cable termination and apparatus and underwater connectors in which a protected environment is provided around an area where a cable is to be terminated, or an area where a contact terminal of one connector part is to engage with a contact terminal of another connector part, respectively. The protected environment may be provided in a chamber having a wall formed by a boot or flexible diaphragm. The boot is filled with fill material such as an oil, gel or other fluid. The outside of the boot is exposed to ambient pressure and because the boot is flexible it provides pressure balancing between the inside of the chamber and the outside. An example of such a boot is depicted in GB 2192316 A, which relates to underwater electrical connectors.

The known boot has a cylindrical configuration such that when the chamber is viewed in cross section it has a circular perimeter. The boot may be filled with oil in a workshop at room temperature. It may then be taken to an offshore deployment site where the local temperature may be higher or lower. Because of the possibility that the apparatus may be on a deck of a ship in hot sunshine, the apparatus may be able to accommodate thermal expansion of the fill material causing the chamber to enlarge and the boot to expand and stretch in a radially outward direction. The apparatus may then be deployed subsea, where it may be at a temperature of 5° C. or lower in some parts of the world. When subsea, the apparatus is subject to pressures much higher than atmospheric. The reduction in temperature and the increase in pressure both tend to cause the fill material in the boot to contract in volume, with the result that the boot deflects in the radially inward direction. In the case of an underwater connector, where male contact pins enter into the chamber to establish an electrical connection, this increases the volume of material in the chamber, to which the flexible boot responds by deflecting in the radially outward direction.

Viewed from a second aspect, the underwater connecting apparatus includes a flexible diaphragm defining a wall of a chamber containing fill material, the wall having, when the chamber is viewed in cross-section, a perimeter with a non-circular profile, the non-circular profile allowing the volume of the chamber to change without substantially changing the length of the perimeter.

With such an arrangement, if the volume of the chamber changes due to changes in the surrounding conditions, the flexible diaphragm is able to permit this without itself undergoing any significant stretching. This may provide an improved pressure balancing effect as between external and internal pressure. In the known apparatus, the resistance of the cylindrical boot to stretching when a volume change occurs results in a differential pressure between outside and inside, with the outside pressure being greater than the inside pressure. A primary purpose of the boot is to balance the pressures whereby they are as close to equal as possible. If the external pressure is greater than the internal pressure, then water or other contaminants are more likely to leak into the protected environment within the boot. For example, in a known apparatus, if the external pressure is 300 bar the internal pressure may be 290 bar. By using underwater connecting apparatus in accordance with the second aspect, a lower pressure differential may be achieved. For example, in certain embodiments, the pressure differential may be as low as 0.1 bar when using oil as the fill material, or as low as one or two bars when using gel as the fill material.

A further benefit of minimizing the change in length of the perimeter of the flexible diaphragm wall is that by reducing the amount of stretching there will be less likelihood of material degradation over time, caused, for example, by fatigue.

The underwater connecting apparatus may be configured for electrical signal or data transmission. It may be configured to handle relatively low voltages, such as a peak or maximum of 1 kV or less. The underwater connecting apparatus may be configured for electrical power transmission. It may be configured to handle alternating root mean square (RMS) voltages up to 5 or 10 or 20 or 30 or 40 or 50 or 60 or 70 or 80 or 90 or 100 or 110 or 120 or 130 or 140 kV or above.

The underwater connecting apparatus may be configured for optical transmission, for example, via optical fibers. The cable may contain optical fibers and/or electrical conductors.

The underwater connecting apparatus may be an underwater connector. It may include a first connector part configured to be interengaged with a second connector part to effect an electrical and/or optical connection. The connection may take place between respective electrical and/or optical conductors. In the case of electrical conductors, these may be contact terminals. Thus the apparatus may include a contact terminal, for example, a contact socket. The connector may be a wet mateable connector, e.g., one which may be mated underwater. It may be a dry mate connector, e.g., one which is mated in dry conditions and then taken under water.

The underwater connecting apparatus may provide a cable termination, for example, terminating a cable to another item such as the back of a connector part, to a bulkhead, or to a cable harness for connecting one cable to another. The cable may extend into the chamber. The apparatus may include an electrical and/or optical conductor to which a second electrical and/or optical conductor belonging to a cable is to be connected. In the case of an electrical conductor, this may be a contact terminal for engagement with the second electrical conductor of the cable, such as a crimp sleeve, for example.

The fill material in the chamber may be a fluid such as oil or gel.

The chamber may extend in an axial direction and the non-circular perimeter is as viewed in cross section transverse to the axial direction.

For example, the chamber may be substantially cylindrical, the cylinder having a non-circular cross sectional shape. In the case that the underwater connecting apparatus includes a connector part, the connector part may be arranged to receive a contact pin that enters the connector part in the axial direction. In the case that the underwater connecting apparatus is a cable termination apparatus, then the cable will extend into the chamber in the axial direction.

Because the flexible diaphragm has a wall with a non-circular perimeter, when the volume of the chamber increases the profile of the wall may move closer to a circular profile, to accommodate the increase in volume without substantially changing the length of the perimeter. This may be achieved, for example, with a profile having substantially straight sides interconnected by rounded corners, for example, three or four such straight sides.

The perimeter may be provided with at least one groove to form the non-circular profile. In this case, if the volume of the chamber increases then a groove, as viewed from outside of the chamber, may move outwardly. If the volume of the chamber decreases, which will be the usual situation when the apparatus is taken from above water to underwater, and external pressure increases, the region adjacent to a groove, as viewed from the outside of the chamber, may move inwardly. A plurality of grooves may be provided. The grooves may be adjacent to each other or they may be spaced from each other along the perimeter.

If the chamber is considered as extending in an axial direction, the groove, or each groove, may extend in the circumferential direction normal to the axial direction.

The groove, or each groove, may extend in the axial direction. The wall may be fluted.

The wall perimeter of the flexible diaphragm may have a wave shaped profile. In this case, if the volume of the chamber increases then a trough of a wave, as viewed from outside of the chamber, may move outwardly. If the volume of the chamber decreases, and external pressure increases, the peak of a wave, as viewed from the outside of the chamber, may move inwardly. The wave shaped profile of the wall perimeter may extend over part of the perimeter, or over the entire perimeter. The waves of the wave shaped profile of the wall perimeter may all be the same as each other. The waves of the wave shaped profile of the wall perimeter may all have the same amplitude. The waves may all have the same period, e.g., the same width.

The wall perimeter may have a wave shaped profile with waves of dissimilar shape. Such an arrangement may be used to predetermine the manner in which the flexible diaphragm will deform when there is a volume change of the chamber.

The wall perimeter may have a wave shaped profile wherein adjacent waves are dissimilar whereby one is stiffer than the other when subjected to loading caused by a change in volume of the chamber. This may be achieved, for example, by a wave peak having a smaller width than an adjacent wave peak. This may be achieved by a wave peak may have a greater curvature, (e.g., a smaller radius), than an adjacent wave peak. A wave peak with a greater curvature than an adjacent wave peak may have a greater height than an adjacent wave peak.

In certain embodiments, the wall perimeter has a wave shaped profile wherein at least one wave peak of a first curvature is located between two wave peaks of a second curvature larger than the first curvature. By increasing the curvature of a wave peak, the corresponding portion of the wall perimeter tends to retain its shape when there is a change in volume of the chamber. It is stiffer than a wave peak of smaller curvature.

By forming the wall perimeter with a wave shaped profile in which a wave peak with a first smaller curvature is located between two larger curvature wave peaks, when there is a chamber volume reduction, the portion of the wall perimeter corresponding to the wave peak with the first smaller curvature tends to move inwardly, whilst the portions of the wall corresponding to the wave peaks of the second larger curvatures remain relatively stable. When there is a chamber volume increase, the portions of the wall perimeter corresponding to the troughs on each side of the wave peak with the first smaller curvature tend to move outwardly, whilst the portions of the wall corresponding to the wave peaks of the second larger curvatures remain relatively stable. Thus, with such an arrangement, the wall perimeter responds to volume changes in a predictable manner. The cross-sectional shape of the wall perimeter may remain rotationally symmetrical during volume changes, rather than deforming asymmetrically. Asymmetric deformation may bring the wall into contact with components inside the chamber and this would be undesirable. There may be a single wave peak of a first curvature located between two wave peaks of a second curvature larger than the first curvature. There may be two or more wave peaks of a first curvature located between two wave peaks of a second curvature larger than the first curvature. In certain embodiments, there are two wave peaks of a first curvature located between two wave peaks of a second curvature larger than the first curvature.

In one example, the wall perimeter may have a wave shaped profile with nine wave peaks, as viewed from the outside of the chamber. There may be three wave peaks having a larger curvature, each separated in the direction around the perimeter from the next larger curvature wave peak by two wave peaks of the first smaller curvature. This may be useful in a case where there are three components inside the chamber extending perpendicularly to the wave shaped profile of the wall as viewed in cross section, for example, in the case of a three cable termination apparatus, because each cable may be positioned inwardly of and adjacent to a portion of the wall corresponding to a wave peak of the second larger curvature.

In certain embodiments, the underwater connecting apparatus includes a longitudinally extending member (e.g., a cable) that extends into the chamber and is located radially inwardly of and adjacent to a part of the wall perimeter that is concave as viewed from the inside of the chamber. In the arrangements mentioned above where the wall perimeter has a profile with straight sections connected at rounded corners, such a longitudinally extending member may be located radially inwardly of and adjacent to a rounded corner. In the case of a wall perimeter with a wave shaped profile, the longitudinally extending member may be located radially inwardly of and adjacent to a concave part of the wall perimeter, as viewed from the inside of the chamber, which is formed by a wave peak, as viewed from the outside of the chamber.

In one embodiment, at least two longitudinally extending members (e.g., cables) extend into the chamber, a first such longitudinally extending member being located radially inwardly of and adjacent to the concave part of the wall perimeter that is formed by one of the two wave peaks of the second curvature, and a second such longitudinally extending member being located radially inwardly of and adjacent to the concave part of the wall perimeter that is formed by another of the two wave peaks of the second curvature.

The apparatus may include more than one chamber. The chamber, or each additional chamber, may have a flexible diaphragm defining a wall having a perimeter with a non-circular profile. In certain embodiments, there is a first chamber having a flexible diaphragm defining a wall, the flexible diaphragm being exposed on an outer surface thereof to pressure in a second chamber, the second chamber having a flexible diaphragm defining a wall, the flexible diaphragm of the second chamber being exposed on an outer surface thereof to external ambient pressure or to pressure in a third chamber. Thus, the flexible diaphragm of the first chamber may provide pressure balancing between the first and second chambers. The flexible diaphragm of the second chamber may provide pressure balancing between the second chamber and the pressure outside thereof, e.g., ambient pressure or the pressure in the third chamber.

In such an arrangement, the flexible diaphragm of the first chamber may define a wall having a perimeter with a non-circular profile. The flexible diaphragm of the second chamber may define a wall having a perimeter with a non-circular profile. If a third chamber is provided, this may also have a flexible diaphragm defining a wall having a perimeter with a non-circular profile.

The chamber, or each additional chamber, may contain fill material such as a polymeric solid, (for example, a silicone elastomer), or a fill material that is a fluid such as oil or gel.

In the embodiments with more than one chamber, and a connection between electrical and/or optical conductors, such a connection may be made in the first chamber. The first chamber may contain fill material such as a polymeric solid, for example, a silicone elastomer, or a fill material that is a fluid such as oil or gel.

In a third aspect, an underwater connecting apparatus and assemblies with an improved flexible diaphragm are provided.

It is known to terminate an underwater cable to a bulkhead of a subsea installation, to the back end of an underwater connector, or to a harness that provides an intermediate unit between a cable and another cable or subsea installation or connector. It is also known to provide underwater connectors having first and second connector parts provided with respective contact terminals that interengage in the mated condition of the connector. Such underwater connectors may be wet mateable, in that they may be mated when underwater, or they may be dry mate connectors, in that they are connected in dry conditions before being taken underwater.

In each of the above cases, it is known to provide a protected environment around an area where one electrical conductor makes an electrical connection with another electrical conductor. An example of an underwater connector having a protected environment where a connection between electrical terminals of respective connector parts is to take place is depicted in GB 2192316A. The protected environment is provided in a chamber having a wall formed by a boot or flexible diaphragm. The boot is filled with a fluid such as an oil or gel. The boot is exposed on an outside surface to pressure outside of the chamber and because the boot is flexible it provides pressure balancing between the inside of the chamber and the region outside of the chamber.

It is also known to provide a protected environment around an underwater cable termination, e.g., the region where a cable conductor is electrically connected to another component, by forming a solid electrical insulation body around the conductors. The solid electrically insulating body may be made of a polymeric or ceramic material. This body is surrounded by a bath of fluid contained in a chamber having a flexible diaphragm defining a wall of the chamber. The flexible diaphragm has an outer surface exposed to pressure outside of the chamber, thereby providing pressure balancing between the external pressure and the pressure inside the chamber. The intention is to suppress the ingress of water or other contaminants into the chamber.

Viewed from a third aspect, an underwater connecting apparatus includes a flexible diaphragm defining a wall of a chamber for receiving therein an electrical conductor and for containing an electrically insulating material around the conductor, wherein the flexible diaphragm includes an electrically conductive material.

Because the flexible diaphragm includes an electrically conductive material, it is able to provide an electrical screen or shield around the chamber and hence, in use, around the electrical conductor. At the same time, its flexibility enables the chamber to experience volume changes in response to temperature or pressure variations, for example.

The underwater connecting apparatus may be an underwater connector. It may include a first connector part configured to be interengaged with a second connector part to effect an electrical connection. The electrical connection may take place in the chamber and be between respective electrical conductors. The electrical conductors may be contact terminals. Thus, the electrical conductor may be a contact terminal, for example, a contact socket, located in the chamber. The connector may be a wet mateable connector, e.g., one which may be mated underwater. It may be a dry mate connector, e.g., one which is mated in dry conditions and then taken under water.

The underwater connecting apparatus may provide a cable termination, for example, terminating a cable to another item such as the back of a connector part, to a bulkhead, or to a cable harness for connecting one cable to another. The cable may extend into the chamber. The electrical conductor may be connected in the chamber to a second electrical conductor belonging to the cable. The electrical conductor may be a contact terminal for engagement with the second electrical conductor of the cable, such as a crimp sleeve, for example.

The apparatus may include the electrical conductor, and the chamber is arranged to receive a second electrical conductor to make an electrical connection with the first mentioned electrical conductor in the chamber. The first and second electrical conductors may be respective contact terminals of first and second connector parts. The second electrical conductor may be the conductor of a cable and the first electrical conductor a contact terminal of the apparatus.

The underwater connecting apparatus may be configured for electrical signal or data transmission. Thus, the electrically conductive flexible diaphragm may serve to screen the signals from interference, or to prevent cross talk between conductors on opposite sides of the flexible membrane. The underwater connecting apparatus may be configured to handle relatively low voltages, such as a peak or maximum of 1 kV or less.

The underwater connecting apparatus may be configured for electrical power transmission. It may be configured to handle alternating root mean square (RMS) voltages up to 5 or 10 or 20 or 30 or 40 or 50 or 60 or 70 or 80 or 90 or 100 or 110 or 120 or 130 or 140 kV or above.

The flexible diaphragm may be arranged to be earthed in use. Because the flexible diaphragm includes an electrically conductive material, it is possible to contain an electric field to within the chamber. In use, when the electrical conductor is received in the chamber and is connected to an electrical source, this will generate an electric field around the conductor, the strength of which decreases with distance away from the conductor. If the flexible diaphragm is earthed then the electric field reduces to zero at the diaphragm. The electrically insulating material contained in the chamber is subject to electrical stress due to the electric field gradient, whereas the region outside of the electrically conductive flexible diaphragm is shielded from the electric stress.

This is unlike the known equipment in which pressure balancing fluids outside of the electrically insulating material around the conductor are also subject to electrical stress and effectively form part of the electrical insulation system. They are therefore required to have suitable properties as a dielectric insulator. The dielectric quality of the pressure balancing fluid may degrade over time due to water ingress, for example, due to water permeating through elastomeric seals or bladders, or in the case of a wet mateable connector due to performing several wet mate connections, or due to a catastrophic failure of any of the sealing components of the equipment. If water leaks into the pressure balancing fluids, the electrical gradient may create a tendency for it to spread out over a myriad of paths, known as water treeing. Loss of dielectric performance of the pressure balancing fluids leads to a reduction in electrical performance of the equipment and in the long term may lead to electrical failure. The provision of an earthed electrically conductive flexible diaphragm addresses these problems.

The flexible diaphragm may be made from electrically conductive materials known for use in the on shore electrical power and distribution industry. The electrically conductive material of the flexible diaphragm may be an electrically conductive silicone rubber. One suitable material is Powersil 440 available from Wacker Chemie AG.

The electrically conductive flexible diaphragm may extend in an axial direction and may form at each axial end a seal with another component, such as a seal holder. The flexible diaphragm may be generally cylindrical. This may be the arrangement, for example, in a wet mateable connector having first and second parts where an electrical connection is established in the chamber that is provided in one of the connector parts.

The electrically conductive flexible diaphragm may be arranged to engage a radially outwardly facing surface of a member extending axially into the chamber. The engagement may be a sealing engagement. The member may be a cable that extends into the chamber. The radially outwardly facing surface may belong to a cable screen of a cable. The cable screen may be earthed. Thus, the electrically conductive flexible diaphragm may effectively provide a continuation of the cable screening. At the other end of the chamber, the flexible diaphragm may be held in sealing manner in electrical engagement with a conductive body that is also earthed. Internally of the flexible diaphragm, inside the chamber, the insulating material will in use be subject to electrical stress, but the region outwardly of the flexible diaphragm is shielded from electrical stress.

In certain embodiments, the chamber extends in an axial direction and has a diameter at one axial end smaller than at the other axial end. In the case of an electrically conductive flexible diaphragm that engages with a radially outwardly facing surface of a member extending axially into the chamber, such as a cable, the engagement may take place at the axial end of smaller diameter. The engagement at this end may be a sealing engagement. The diameter at the other axial end is larger and thereby creates space radially outwardly of the member, (e.g., cable), for the insulating material. The larger diameter end of the flexible diaphragm may seal to a seal holder, such as an electrically conductive body. The apparatus may further include the insulating material. The insulating material may be a polymeric solid material, for example, silicone elastomer. The insulating material may be a fill material. It may be introduced into the chamber when in a flowable form, where the insulating material then solidifies. By introducing the material in flowable form, this may assist with avoiding or minimizing the presence of air pockets in the chamber.

Particularly when the apparatus is used at high voltages, if there are air pockets subject to a high electrical stress, then there maybe arcing, potentially causing failure of the apparatus.

The electrically insulating material may be chosen for its insulating properties and ability to withstand electrical stress. Any material outwardly of the flexible diaphragm may be chosen for other properties, for example, to provide pressure balancing between external ambient pressure and the pressure in the chamber.

In certain embodiments, the chamber is a first chamber, and the flexible diaphragm has an outer surface exposed to pressure in a second chamber. Thus, the flexible diaphragm may provide pressure balancing between the first and second chambers. The second chamber may be filled with a fluid such as oil or gel. The second chamber may be provided with a second flexible diaphragm defining a wall thereof, and the second flexible diaphragm has an outer surface exposed to pressure outside of the second chamber. The outside pressure may be the ambient pressure of the underwater environment. In an embodiment, however, the second flexible diaphragm is exposed to pressure in a third chamber. The third chamber may contain a fluid such as oil or gel. The third chamber may be provided with a third flexible diaphragm defining a wall of the third chamber, and a third flexible diaphragm may have an outer surface exposed to external ambient pressure.

In the above arrangement, in the case of a cable termination, a cable may extend longitudinally through the second chamber and into the first mentioned chamber. For water to leak into the first chamber by following a leak path along the cable, it would first have to enter the second chamber before entering the first chamber. Thus, the second chamber provides protection against water ingress for the first chamber. Since the flexible diaphragm defining the wall of the first chamber has an outer surface exposed to pressure in the second chamber, pressure balancing between the two chambers is provided by the flexibility of the diaphragm. This tends to suppress leakage from the second chamber into the first mentioned chamber.

If a third chamber is provided, then a leakage path, in the case of a cable termination, along the cable would involve water entry first into the third chamber, then into the second chamber and then lastly into the first chamber. Thus the presence of the third chamber provides additional protection. If the second chamber has a wall defined by a flexible diaphragm the outer surface of which is exposed to pressure in the third chamber, then there is pressure balancing between the second and third chambers, thereby tending to suppress leakage from the third chamber into the second chamber.

If a second or a third chamber is/are provided, and the chamber(s) is/are filled with fluid to provide a pressure balancing function, then volume changes caused by temperature and pressure changes may tend to result in stretching of the flexible diaphragm. Therefore, in some embodiments, the wall of the second chamber has, when the chamber is viewed in cross-section, a perimeter with a non-circular profile, the non-circular profile allowing the volume of the chamber to change without substantially changing the length of the perimeter. If a third chamber is provided, then the wall of the third chamber may have, when the chamber is viewed in cross-section, a perimeter with a non-circular profile, the non-circular profile allowing the volume of the chamber to change without substantially changing the length of the perimeter.

With these arrangements, if the volume of the respective chamber changes due to changes in the surrounding conditions, the flexible diaphragm is able to permit this without itself undergoing any significant stretching. This may provide an improved pressure balancing effect as between external and internal pressure. The pressure differential across the respective flexible diaphragm may be reduced as compared to diaphragms having a circular cross-sectional profile. By balancing the pressures whereby they are as close to equal as possible, any tendency for water or other contaminants to enter into the respective chamber is reduced. Moreover, by substantially avoiding a change in length of the perimeter of the chamber wall in response to volume changes, there will be a reduced likelihood of material degradation over time, caused, for example, by fatigue.

The perimeter of the second chamber wall may have a wave shaped profile. If a third chamber is provided with a third flexible diaphragm defining a wall, then the perimeter of the third chamber wall may have a wave shaped profile. A wave shaped profile is useful in allowing the volume of the chamber inwardly of the wall to change without substantially changing the length of the perimeter. If the chamber is considered as extending in an axial direction, the wave may extend axially. Grooves formed between peaks of the wave may then extend in the circumferential direction normal to the axial direction. The perimeter of the respective chamber wall may have a wave shaped profile when viewed in cross section transverse to the axial direction. In this case, the wall of the second chamber and/or that of the third chamber has axially extending grooves. The chamber wall may be fluted.

In certain arrangements, the second flexible diaphragm includes an annular seal member that in use is to engage in sealing manner with a radially inner member in order to seal between the second chamber and a region outside of the second chamber, the annular seal member including a first annularly and axially extending portion that in use is to engage the radially inner member and to extend axially along the radially inner member inwardly into the second chamber, the first portion being exposed to pressure in the second chamber, and a second annularly and axially extending portion that in use is to engage the radially inner member and to extend axially along the radially inner member away from the chamber, the second portion being exposed to pressure in the region outside the chamber.

In use, the first annularly and axially extending portion is exposed to the pressure inside the second chamber, and the second annularly and axially extending portion is exposed to pressure in the region outside the second chamber, which may be that of ambient water, or of the third chamber it provided, or of fluid provided in a hose. In each case, the pressure may urge the respective annularly and axially extending portion against the radially inner member to seal thereagainst.

The radially inner member may be the jacket of a cable that extends into the apparatus.

The embodiments also extend to a cable termination assembly including the apparatus as discussed herein in relation to the third aspect, and further including a cable that extends into the chamber having a wall defined by the electrically conductive flexible diaphragm. If a second chamber is provided the cable may extend into it, and if a third chamber is provided the cable may extend into that chamber. In one assembly, a cable extends from outside of the apparatus through one or more outer chambers and into an inner chamber that has the wall defined by the electrically conductive flexible diaphragm.

The flexible diaphragm including an electrically conductive material may engage a conductive screen of the cable.

DETAILED DESCRIPTION

Figure 1:
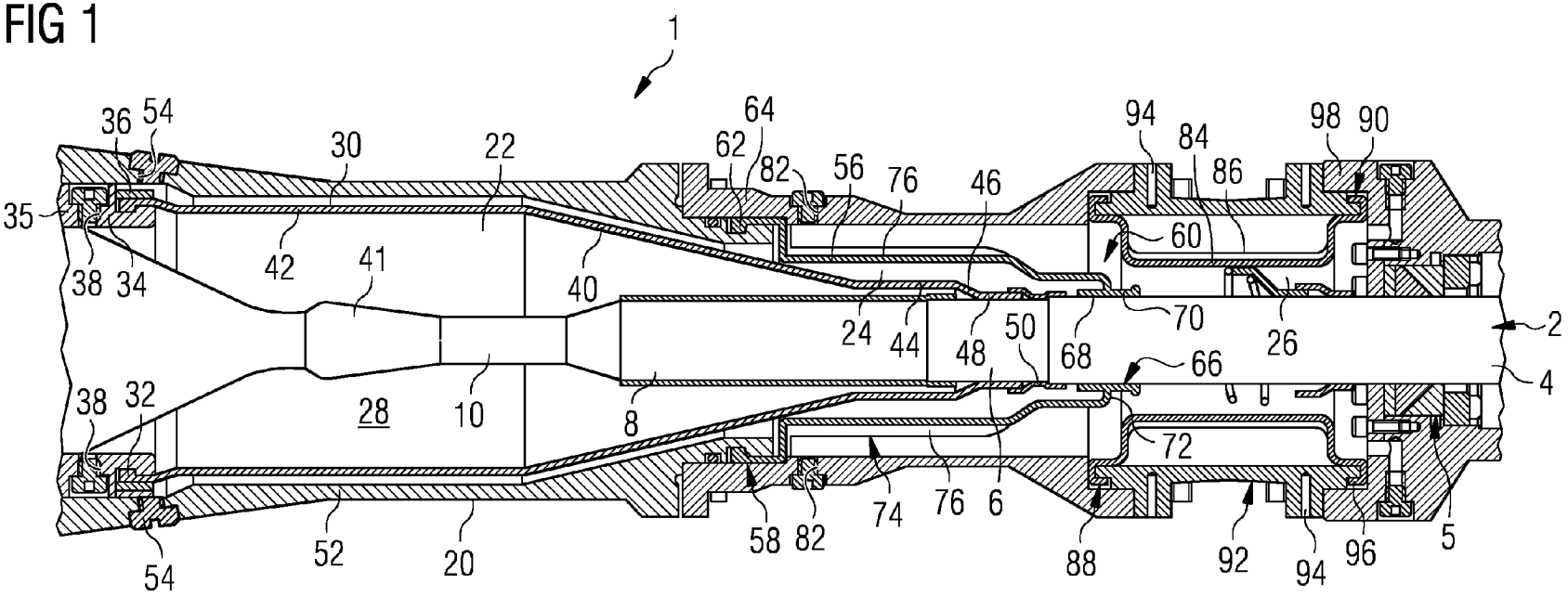
FIG. 1 depicts an axial cross sectional view of an underwater connecting apparatus according to a first embodiment.

Referring to FIG. 1, the figure depicts an underwater connecting apparatus 1 for connecting a cable 2 to a bulkhead of a subsea installation. The underwater connecting apparatus of this embodiment is thus a cable termination apparatus for an underwater cable, serving to connect a cable to a conductive core that passes across a bulkhead and into a subsea installation. It is intended to be used at high voltages, for example, with an alternating voltage up to 72 kV peak to peak (51 kV RMS) or 36 kV peak to ground.

The cable 2 is depicted in its final configuration when terminated, after it has been dressed by stripping back its various coaxial layers. It is of a known type, including an external armor enclosing a cable jacket that is made of lead and acts as an environmental shield, protecting the cable layers inwardly of the jacket. There is provided radially inwardly of the cable jacket 4 a semi-conductive screen layer 6, inwardly of that an insulating layer 8 made of cross-linked polyethylene (XLPE), and inwardly of that an inner semi-conductive screen layer 10. An inner conductor, made of copper, is surrounded by the inner semi-conductive screen layer.

The cable 2 enters the apparatus 1 at the right hand end as seen in FIG. 1, extending in a forward direction into the apparatus. To the right of the drawing the external armor of the cable is gripped in known manner by a strain relief. The armour is removed forwardly of the strain relief to expose the cable jacket 4, which is sealed by a cone seal 5. The dressing of the cable results in exposure of the screen layer 6 forwardly of where the cable jacket 4 is terminated, exposure of the insulating layer 8 forwardly of where the screen layer 6 is terminated, and exposure of the inner semi-conductive screen layer 10 forwardly of where the insulating layer 8 is terminated. At the forward end of the cable, the inner conductor is exposed and connects to a conductive core that passes across a bulkhead and into a subsea installation.

The cable termination apparatus includes a housing 20 in which three chambers 22, 24 and 26 are provided. An inner chamber 22 is filled with a silicone elastomer fill material 28, an intermediate chamber 24 contains pressure balancing fluid such as oil or gel, and a rear chamber 26 also contains pressure balancing fluid such as oil or gel.

The silicone elastomer fill material 28 in the inner chamber 22 surrounds a cable conductor contact region 41 where the cable conductor makes an electrical connection with the conductive core of the cable termination apparatus. The fill material 28 is contained by a flexible diaphragm 30 that forms a boot around the chamber 22. The flexible diaphragm 30 is made of a conductive material, more particularly a conductive silicone elastomer.

The flexible diaphragm 30 has a large diameter cylindrical portion 42 at its front end around the cable conductor contact region 41 and is formed with an annular lip 32 held by a seal holder 34 that is part of a bulkhead mounting plate 35. The lip 32 is restrained by a retaining ring 36. A pair of openings 38 are provided in the bulkhead mounting plate 35, enabling introduction of the fill material 28 when in liquid form into the chamber 22 and escape of air during such introduction. During assembly of the apparatus, after the chamber has been filled the fill material solidifies to form an insulating body around the cable conductor contact region 41. The flexible diaphragm 30 has a conical portion 40 decreasing in diameter from the large diameter cylindrical portion 42 in the rearward direction, away from the cable conductor contact region 41. It joins a smaller diameter cylindrical portion 44, which is joined by another conical portion 46, decreasing in diameter in the rearward direction, to a cable engaging cylindrical portion 48. The portion 48 engages the semi-conductive cable screen layer 6 of the cable 2. In an unstressed condition, it has an internal diameter slightly smaller than the outer diameter of the screen layer 6, in order to seal against and make a good electrical connection therewith. The portion 48 is further held in place by an annular retaining band 50.

It will therefore be seen that the semi-conductive flexible diaphragm 30 makes electrical contact with the cable screen layer 6 at its end remote from the cable conductor contact region 41 and further makes electrical contact with the seal holder 34, which is part of the conductive bulkhead mounting plate 35 that is to be bolted to the bulkhead of the subsea installation. In use, the bulkhead, the bulkhead mounting plate 35, the seal holder 34, the flexible diaphragm 30 and the cable screen 6 will be earthed. The conductor of the cable and the conductive core of the cable termination apparatus, to which the cable conductor electrically connects, will be operated at a high electric potential, (for example, up to alternating peak to peak 72 kV), thereby creating an electric field around these components. The fill material 28 in the first chamber 22 accommodates the electric field created between the high voltage centrally positioned conductors and the earthed wall of the chamber provided by the flexible diaphragm 30. Because the flexible diaphragm is conductive, it may shield the region radially outwardly thereof from electric stress. Because it is flexible, the diaphragm is able to deform to accommodate changes in volume of the chamber 22 caused by temperature and pressure variations.

The inner chamber 22 is provided radially inwardly of an intermediate chamber 24 that is filled with a dielectric fluid such as gel or oil. The purpose of the fluid is to enable pressure balancing between the interior of the chamber and the exterior thereof. In the region of the intermediate chamber 24 radially outwardly of the cable conductor contact region 41, the chamber has a front housing wall 52 forming part of the housing 20. The wall 52 is formed with a pair of openings 54 that are used to fill and vent the chamber 24 with fluid during assembly of the cable termination apparatus. Towards the rear of the intermediate chamber 24, the chamber has a wall defined by a flexible diaphragm 56 that forms a boot around the chamber. The flexible diaphragm 56 is made of elastomeric material and is able to flex in response to volume changes inside and outside of the chamber caused by pressure and temperature variations. The flexible diaphragm 56 has a large diameter front end 58 and a small diameter rear end 60. At the front end 58, an annular lip 62 engages in a groove of the front housing wall 52 and is retained there by an intermediate wall 64 of the housing 20.

At its rear end 60 the flexible diaphragm 56 forms an annular seal member 66 that engages in sealing manner with the jacket 4 of the cable 2, thereby sealing the rear end of the chamber 24. The annular seal member 66 has a first annularly and axially extending portion 68 that engages the cable jacket 4 and extends axially and forwardly along the cable jacket into the chamber 24, the first portion being exposed to the fluid in the chamber and hence to the pressure of that fluid. The annular seal member has a second annularly and axially extending portion 70 that engages the cable jacket 4 and extends axially along the cable jacket in a rearward direction, away from the chamber 24, the second portion being exposed to fluid in the outer chamber 26, and hence the pressure in that chamber. The annular seal member has an intermediate annularly extending portion 72, located intermediate of the first and second portions, the intermediate portion being exposed on its forward axial side to pressure in the chamber 24 and exposed on its rearward axial side to pressure in the chamber 26. The intermediate portion 72 extends radially outwardly of the first and second portions 68, 70.

The flexible diaphragm 56 has a generally cylindrical portion 74 extending rearwardly from its front end 58 towards the rear end 60. The cylindrical portion 74 has a non-circular perimeter and is provided with a plurality of axially or longitudinally extending grooves or flutes 76. The grooves 76 are depicted in further detail in FIGS. 2 and 3.

Figure 3:
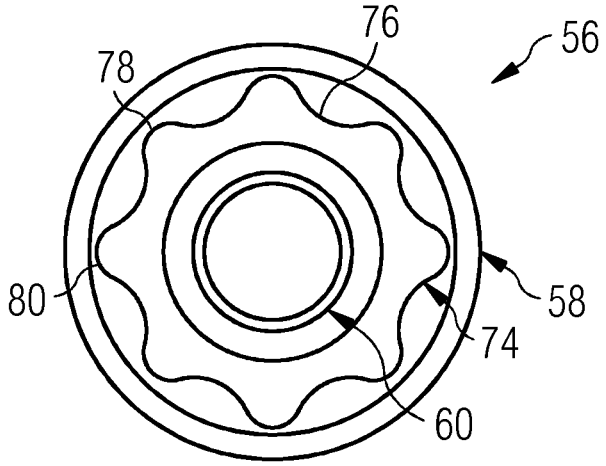
FIG. 3 depicts an end view of the boot of FIG. 2.

The perimeter of the cylindrical portion 74 has a wave shaped profile, considered in a direction around the perimeter of the cylindrical portion, this profile creating the grooves 76, and peaks 78 and 80 on each side of the grooves. As seen in FIG. 3, peaks 78 of the wave have a first curvature and alternate, in a direction around the perimeter of the cylindrical portion, with peaks 80 of a second curvature that is larger than the first curvature. The grooves 76 are formed between adjacent peaks. The first curvature has a larger radius than the second curvature.

In use, if the volume of the intermediate chamber 24 increases, then the larger curvature peaks 80 remain relatively stable whilst the portion of the diaphragm corresponding to the groove 76 on each side of a peak 80 moves in a radially outward direction, so that the groove becomes shallower. In an extreme case, the diaphragm portions corresponding to a pair of grooves 76 on each side of a smaller curvature peak 78 may move to a radial position similar to that of the peak 78.

If the volume of the intermediate chamber 24 decreases, then the larger curvature peaks 80 remain relatively stable whilst the portion of the diaphragm corresponding to the peak 78 between the peaks 80 moves in a radially inward direction, so as to decrease in height. In an extreme case, the diaphragm portion corresponding to a smaller curvature peak 78 may move to a radial position similar to that of the pair of grooves 76 on each side.

By providing at least one smaller curvature wave peak 78 between two larger curvature wave peaks 80, the expansion or contraction of the chamber 24 may take place in a relatively controlled and symmetrical fashion, compared to an alternative profile in which all wave peaks have the same curvature.

Figure 2:
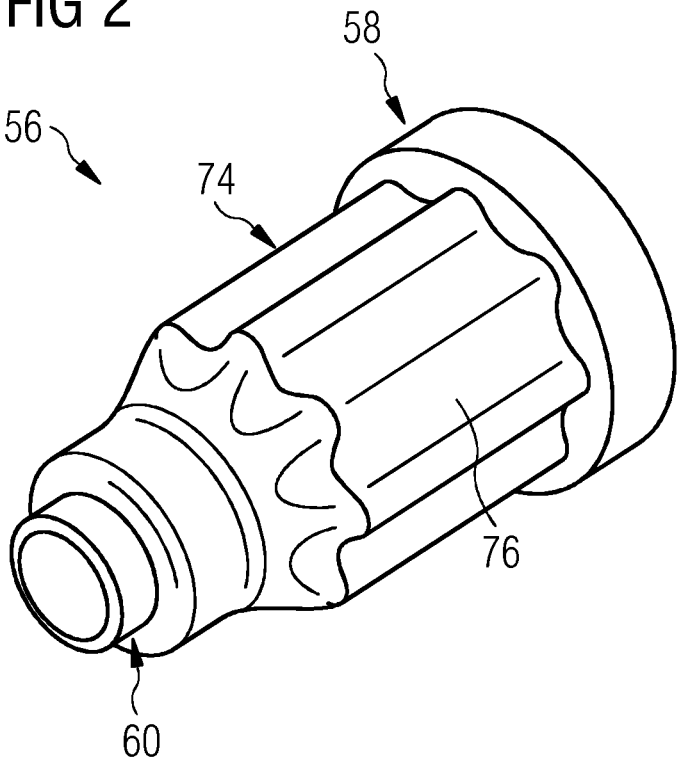
FIG. 2 depicts an isometric view of a boot of the apparatus of the first embodiment.

In the case of the flexible diaphragm 56 depicted in FIGS. 1, 2, and 3, there are eight wave peaks altogether, including four larger curvature peaks 80 and four smaller curvature peaks 78, with the larger and smaller curvature peaks alternating in a direction around the periphery of the diaphragm.

Figure 4:
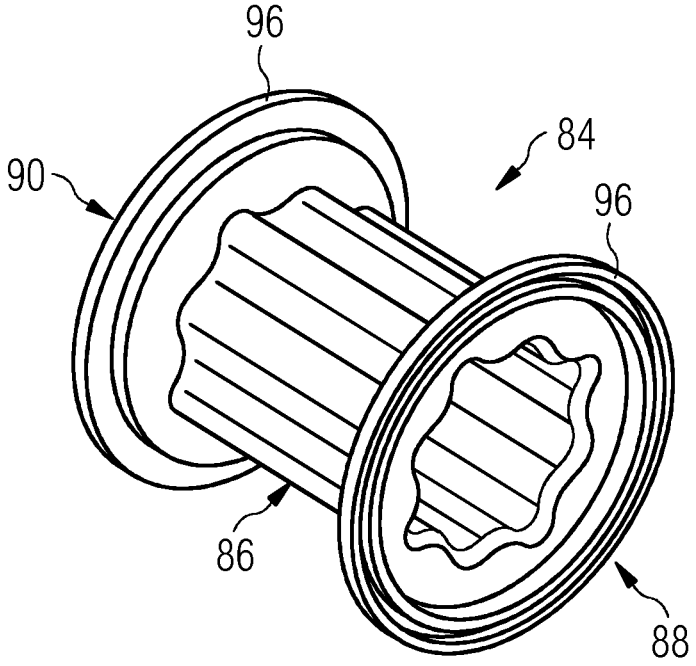
FIG. 4 depicts an isometric view of another boot of the apparatus of the first embodiment.
Figure 5:
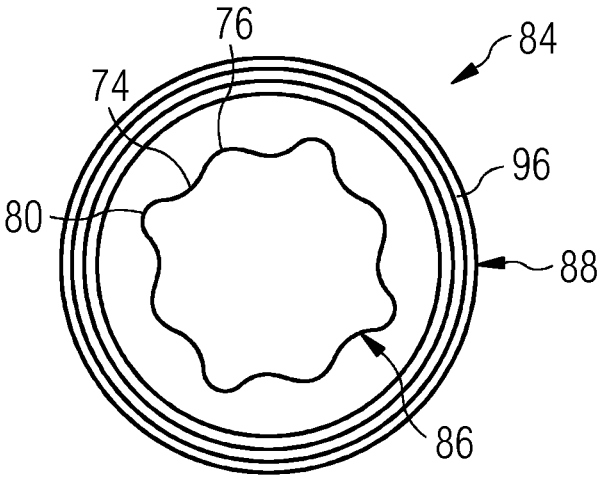
FIG. 5 depicts an end view of the boot of FIG. 4.

The rear chamber 26 extends round the intermediate chamber 24 and also round the part of the cable jacket 4 forwardly of the cone seal 5. The rear chamber 26 contains pressure balancing fluid such as oil or gel. The intermediate housing wall 64 is formed with a pair of openings 82 for introducing the fluid into the chamber during assembly of the apparatus, and for venting air from the chamber. The forward part of the rear chamber 26 is defined radially inwardly of the intermediate housing wall 64 and radially outwardly of the diaphragm 56 defining a wall of the intermediate chamber 24. At the rear of the rear chamber a flexible diaphragm 84 is provided. This is depicted in FIGS. 4 and 5 as well as in FIG. 1.

The diaphragm 84 has a generally cylindrical portion 86 extending between a front end 88 and a rear end 90. Radially outwardly of the cylindrical portion 86 a rear housing wall 92 is formed with radial passages 94 allowing ambient water to enter a region 96 radially inwardly of wall 92 and radially outwardly of cylindrical portion 86. The outside of the cylindrical portion 86 of the flexible diaphragm 84 is thus exposed to ambient water and hence ambient pressure. At its front and rear ends the flexible diaphragm 84 is provided with respective sealing lips 96 that are trapped in a sealing manner between the rear housing wall 92 and a part of the housing radially outwardly thereof. In the case of the front end, the lip is trapped between rear housing wall 92 and intermediate housing wall 64, and in the case of the rear end the sealing lip is trapped between wall 92 and a cable collar wall 98.

The cylindrical portion 86 has a non-circular perimeter and is provided with a plurality of axially or longitudinally extending grooves or flutes 76. The grooves 76 are depicted in further detail in FIGS. 4 and 5.

The perimeter of the cylindrical portion 86 has a wave shaped profile, considered in a direction around the perimeter of the cylindrical portion, this profile creating the grooves 76, and peaks 78 and 80 on each side of the grooves. As seen in FIG. 5, peaks 78 of the wave have a first curvature and alternate, in a direction around the perimeter of the cylindrical portion, with peaks 80 of a second curvature that is larger than the first curvature. The grooves 76 are formed between adjacent peaks.

The manner in which flexible diaphragm 84 functions in response to volume changes of the chamber 26 is similar to that described above in relation to flexible diaphragm 56. By providing at least one smaller curvature wave peak 78 between two larger curvature wave peaks 80, the expansion or contraction of the chamber 26 may take place in a relatively controlled and symmetrical fashion, compared to an alternative profile in which all wave peaks are the same curvature.

Figure 6:
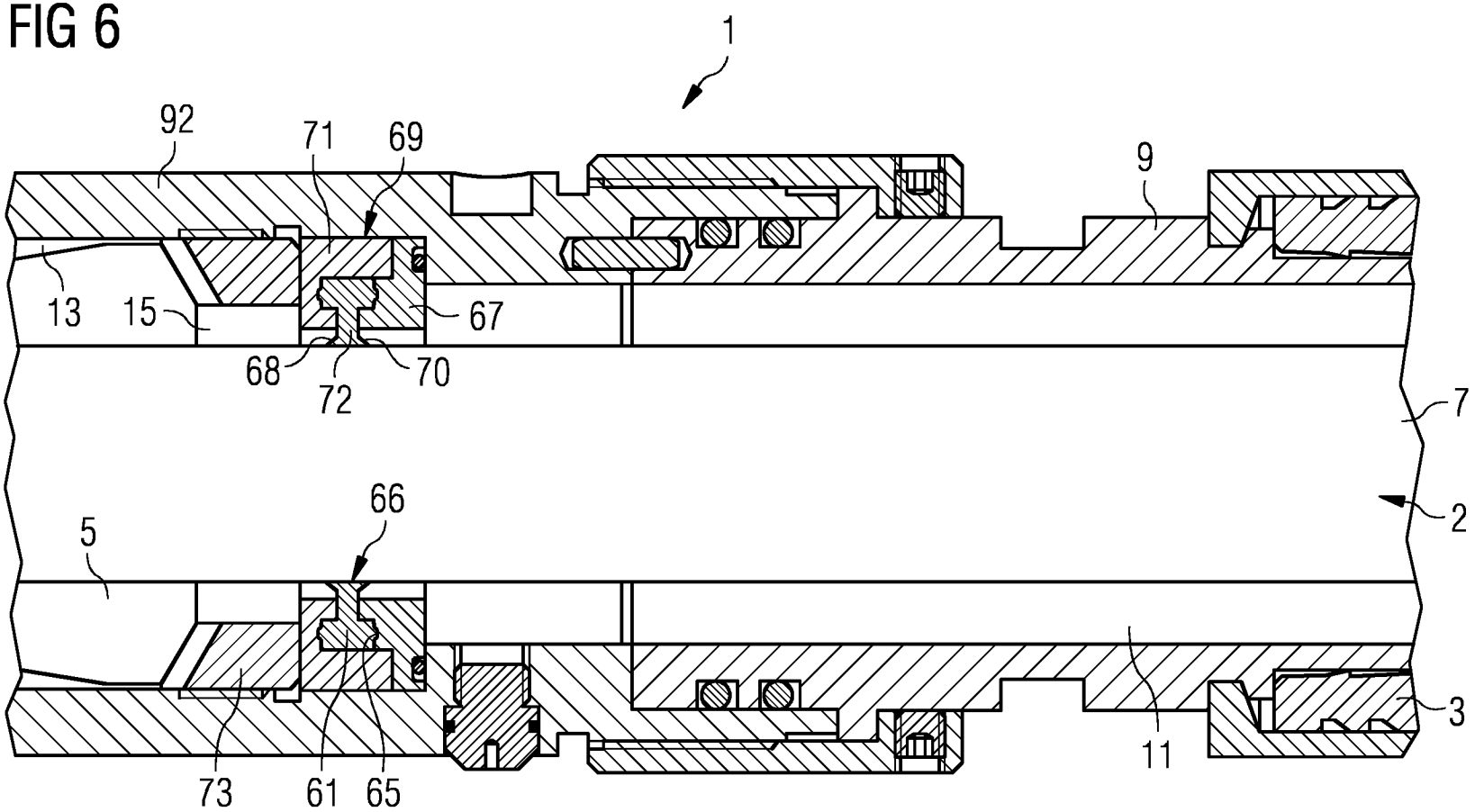
FIG. 6 depicts an axial cross sectional view of part of an underwater connecting apparatus according to a second embodiment.

FIG. 6 depicts a second embodiment of underwater connecting apparatus 1. The drawing depicts a front end of an oil filled hose 3 that carries a cable 2 having a polymeric cable jacket 7. The front end of the outer casing of the hose 3 connects via an adapter 9 to the rear of the underwater connecting apparatus 1, only the rear of the apparatus being depicted in FIG. 6. Further forwardly the cable is dressed, as in the first embodiment, to expose a central conductive core. This core may be connected to a connector part or to a conductor of a bulkhead penetrator or to a conductor of a cable harness, for example. The cable jacket 7 of the cable is gripped by a cable grip 5.

Radially inwardly of the adapter 9 and outwardly of the cable jacket 7 an annular chamber 11 contains oil that is in communication with the oil of the oil filled hose 3. Forwardly of the cone seal 5, a chamber 13 containing fluid such as oil or gel is provided. Only the rear of this chamber is depicted. Further forwardly, it has a wall formed by a flexible diaphragm with an outer surface exposed to ambient pressure, thereby providing pressure balancing of the inside of chamber 13 with respect to ambient pressure, in a known manner. The fluid in chamber 13 is in communication with a sub-chamber 15 to the rear of the cable grip 5.

An annular seal member 66 seals between the sub-chamber 15 and the chamber 11. The annular seal member 66 engages in a sealing manner with the cable jacket 7. It has a first annularly and axially extending portion 68 that engages the cable jacket 7 and extends axially and forwardly therealong into the sub-chamber 15, the first portion being exposed on its radially outer surface to the fluid in the sub-chamber 15, and hence to the pressure in the sub-chamber. The annular seal member has a second annularly and axially extending portion 70 engaging the cable jacket 7 and extending axially and rearwardly therealong into the chamber 11, the second portion 70 being exposed on its radially outer surface to the oil in the chamber 11, and hence to the pressure in the chamber.

The annular seal member 66 has an intermediate annularly extending portion 72, located intermediate of the first and second portions 68, 70, the intermediate portion being exposed on its front axial surface to pressure in sub-chamber 15 and exposed on its rear axial surface to pressure in chamber 11. The annular seal member 66 has a radially outer annularly extending part 61 that is sealed with respect to a rear housing wall 92 of the apparatus. The part 61 is gripped in a recess 65 defined between a rear part 67 of a seal holder 69 and a front part 71 of the seal holder. The front part 71 is urged rearwardly by a locking ring 73 threadedly engaged with the inside of the rear housing wall 92.

Figure 7:
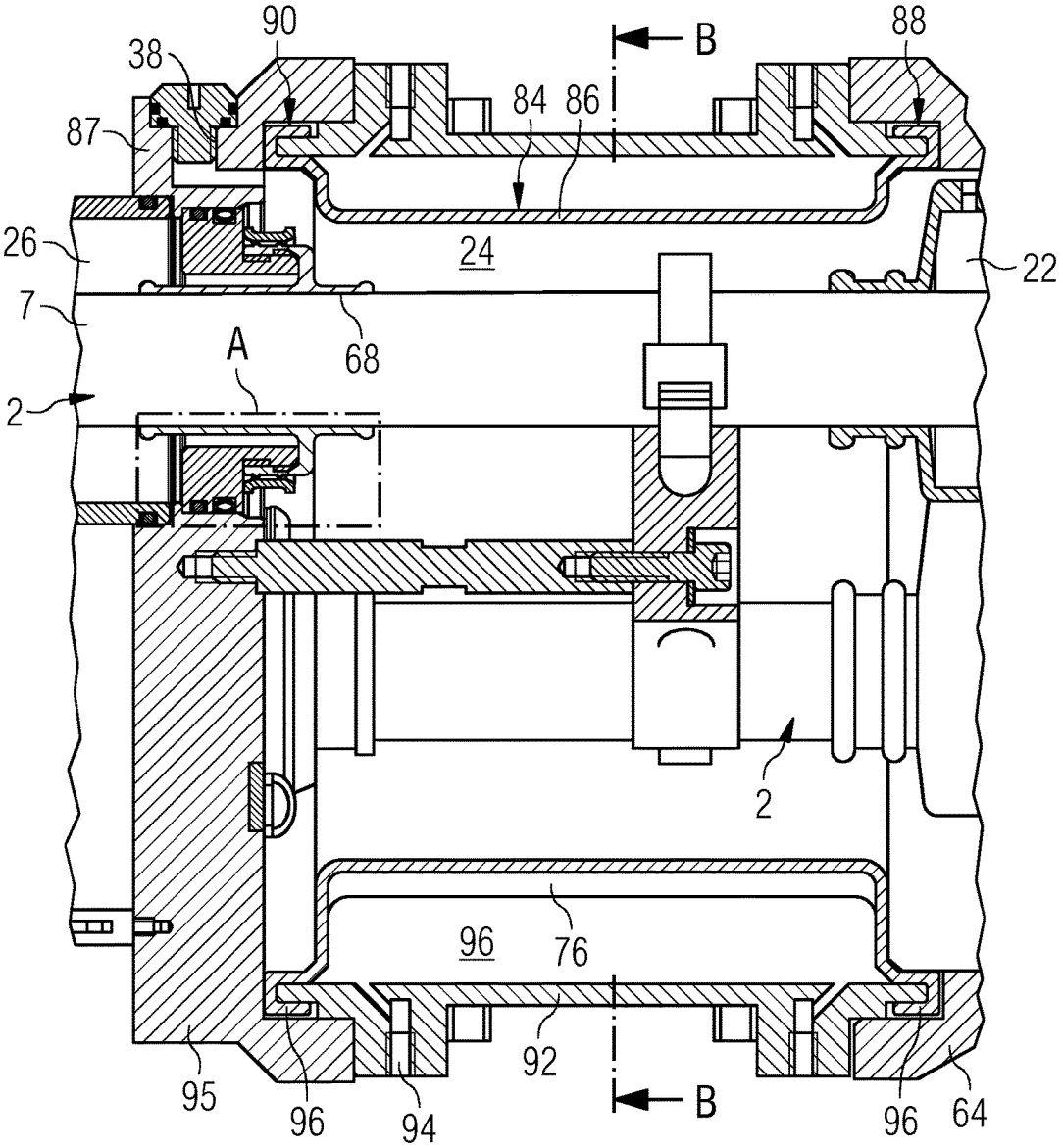
FIG. 7 depicts an axial cross sectional view of part of an underwater connecting apparatus according to a third embodiment.
Figure 8:
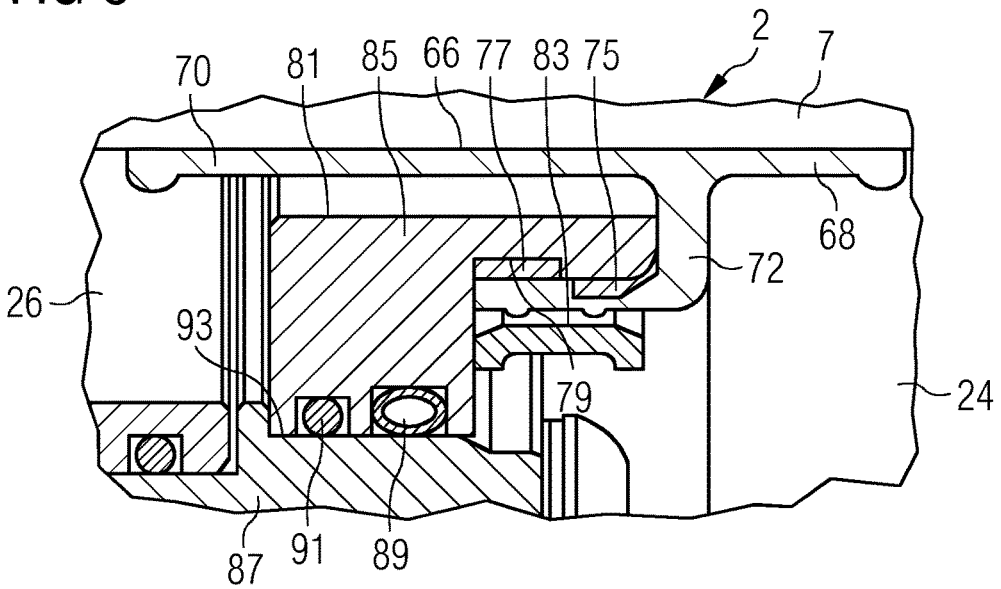
FIG. 8 depicts an enlarged view of the portion of FIG. 7 marked "A".
Figure 9:
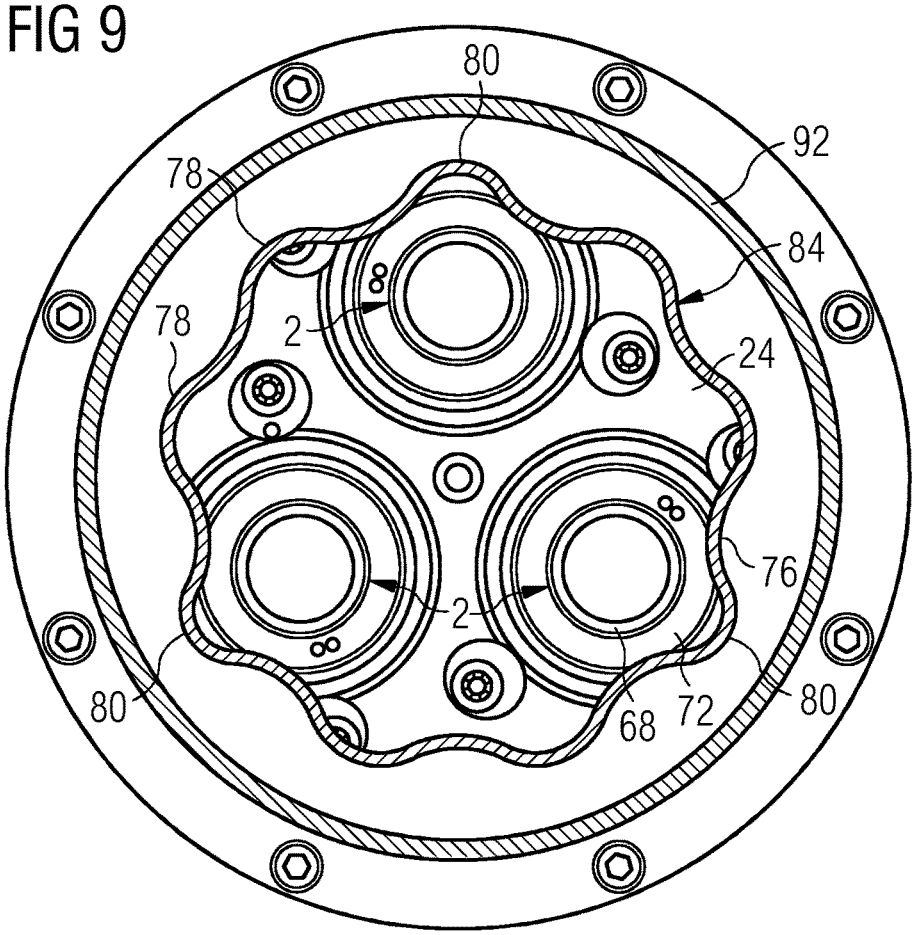
FIG. 9 depicts a transverse cross sectional view of the apparatus of FIG. 7 on the lines B-B.

FIGS. 7 to 9 depict a third embodiment of underwater connecting apparatus, having an inner chamber 22, an intermediate chamber 24, and a rear chamber 26, each of which are filled with fluid such as oil or gel. In this case, the apparatus is a cable harness in which three relatively heavy duty cables 2 extend forwardly (e.g., from left to right as seen in FIG. 7) from the outside environment to where they are dressed to expose a conductive core (e.g., to the right of what is depicted in FIG. 7). The conductive core is connected in the inner chamber 22 via a crimp to a conductive pin and this is connected via another crimp to a lighter duty underwater cable that is better suited for further connection, for example, to the rear end of an underwater mateable connector part. The cable is gripped upon entry to the cable harness by a cable grip (not depicted, e.g., to the left of FIG. 7) and enters the rear chamber 26. The chamber 26 has a wall formed by a flexible diaphragm, the outside of which is exposed to ambient water whereby the pressure in the chamber 26 is balanced with respect to external pressure, in known manner.

The intermediate chamber 24 is provided forwardly of the rear chamber 26.

The two chambers are separated by an annular seal member 66, part of which is depicted in more detail in FIG. 8. The annular seal member 66 engages in sealing manner with a jacket 7 of the cable 2 to seal between chambers 24 and 26. The annular seal member 66 has a first annularly and axially extending portion 68 that engages the cable jacket 7 and extends forwardly and axially along the cable jacket inwardly into chamber 24, the first portion being exposed to the fluid, and hence pressure, in the chamber. In particular, a radially outer surface of the first portion 68 is urged by the chamber pressure into engagement with the cable jacket 7. The annular seal member 66 has a second annularly and axially extending portion that engages the cable jacket 7 and extends rearwardly and axially along the cable jacket into chamber 26. The second portion is exposed to fluid, and hence to pressure, in the chamber 26. It has a radially outer surface that is exposed to this pressure.

The annular seal member 66 has an intermediate annularly extending portion 72, located intermediate of the first and second portions 68, 70, the intermediate portion being exposed on a front axial side thereof to pressure in the chamber 24 and exposed on a rear axial side thereof to pressure in the chamber 26. At the radially outer end of the intermediate portion 72, the seal member 66 has an axially rearwardly extending lip 75 with an annular bead 77 engaging in an annular groove 79 of a seal holder 81. A locking ring 83 holds the lip 75 in position. The seal holder 81 has a main body 85 that engages in a socket 93 of a seal support 87. A canted coil spring 89 holds the seal holder in the socket and an O-ring seal 91 seals the seal holder main body 85 to the socket, thereby preventing fluid communication of chambers 24 and 26 along this path.

The intermediate chamber 24 extends around the three cables 2 forwardly of the annular seal member 66. At least one opening 38 in a housing end cap 95 is provided for introducing fluid into the chamber during assembly of the apparatus, and for venting air from the chamber. A flexible diaphragm 84 defines a wall of the intermediate chamber 24, as depicted in FIG. 9 as well as in FIG. 7.

The diaphragm 84 has a generally cylindrical portion 86 extending between a front end 88 and a rear end 90. Radially outwardly of the cylindrical portion 86 a rear housing wall 92 is formed with radial passages 94 allowing ambient water to enter a region 96 radially inwardly of wall 92 and radially outwardly of cylindrical portion 86. The outside of the cylindrical portion 86 of the flexible diaphragm 84 is thus exposed to ambient water and hence ambient pressure. At its front and rear ends the flexible diaphragm 84 is provided with respective sealing lips 96 that are trapped in a sealing manner between the rear housing wall 92 and a part of the housing radially outwardly thereof. In the case of the front end, the lip is trapped between rear housing wall 92 and an intermediate housing wall 64, and in the case of the rear end the sealing lip is trapped between wall 92 and the housing end cap 95.

The cylindrical portion 86 has a non-circular perimeter and is provided with a plurality of axially or longitudinally extending grooves or flutes 76. The grooves 76 are depicted in further detail in FIG. 9.

The perimeter of the cylindrical portion 86 has a wave shaped profile, considered in a direction around the perimeter of the cylindrical portion, this profile creating the grooves 76, and peaks 78 and 80 to the sides of the grooves. As seen in FIG. 9, peaks 78 of the wave have a first curvature and peaks 80 have a second curvature that is larger than the first curvature. In a direction around the perimeter of the cylindrical portion, there are two first curvature peaks 78 followed by one second curvature peak. Thus, there are two first curvature peaks between two second curvature peaks 80.

Each larger curvature peak 80 is arranged to be located radially outwardly of a respective cable 2. There are nine peaks altogether, with three larger curvature peaks 80 and six smaller curvature peaks 78.

The manner in which flexible diaphragm 84 functions in response to volume changes of the chamber 24 is similar to that described above in relation to flexible diaphragm 56 of the first embodiment. By providing at least one smaller curvature wave peak 78 (and in the case of this embodiment by providing two smaller curvature wave peaks 78) between two larger curvature wave peaks 80, the expansion or contraction of the chamber 24 may take place in a relatively controlled and symmetrical fashion, compared to an alternative profile in which all wave peaks have the same curvature.

In the case of this embodiment, if the volume of the chamber 24 increases, then the larger curvature peaks 80 remain relatively stable whilst the portions of the diaphragm corresponding to the three grooves 76 between each circumferentially adjacent pair of peaks 80 move in a radially outward direction, so that the grooves become shallower. With further expansion, the diaphragm portions corresponding to the grooves 76 may move to a radial position similar to that of the smaller curvature peaks 78.

If the volume of the intermediate chamber 24 decreases, then the larger curvature peaks 80 remain relatively stable whilst the portions of the diaphragm corresponding to the peaks 78 move in a radially inward direction, so as to decrease in height. With further contraction, the diaphragm portions corresponding to the smaller curvature peaks 78 may move to a radial position similar to that of the grooves 76.

Since each larger curvature peak 80 is arranged to be located radially outwardly of a respective cable 2, even with a decrease in volume of the chamber 24, the stability of the peaks 80 may prevent the diaphragm collapsing inwardly onto the cables.

It is to be understood that the elements and features recited in the appended claims may be combined in different ways to produce new claims that likewise fall within the scope of the present invention. Thus, whereas the dependent claims appended below depend from only a single independent or dependent claim, it is to be understood that these dependent claims may, alternatively, be made to depend in the alternative from any preceding or following claim, whether independent or dependent, and that such new combinations are to be understood as forming a part of the present specification.

While the present invention has been described above by reference to various embodiments, it may be understood that many changes and modifications may be made to the described embodiments. It is therefore intended that the foregoing description be regarded as illustrative rather than limiting, and that it be understood that all equivalents and/or combinations of embodiments are intended to be included in this description.

The invention claimed is:

1. An underwater connecting apparatus comprising:

a first flexible diaphragm defining a wall of a first chamber for receiving therein an electrical conductor and for containing an electrically insulating material around the electrical conductor; and a second flexible diaphragm defining a wall of a second chamber, wherein the first flexible diaphragm comprises an electrically conductive material and an outer surface exposed to pressure in the second chamber, and wherein the second flexible diaphragm is exposed to pressure in a third chamber.

2. The apparatus as claimed in claim 1, wherein the insulating material is a polymeric solid material.

3. The apparatus as claimed in claim 1, wherein the first chamber is configured to receive an additional electrical conductor to provide an electrical connection with the electrical conductor in the first chamber.

4. The apparatus as claimed in claim 1, wherein the first flexible diaphragm is configured to be earthed in use.

5. The apparatus as claimed in claim 1, wherein the first flexible diaphragm is configured to engage a radially outwardly facing surface of a member extending axially into the first chamber.

6. The apparatus as claimed in claim 1, wherein the first chamber extends in an axial direction and comprises a first axial end diameter at a first axial end that is smaller than a second axial end diameter at a second axial end.

7. The apparatus as claimed in claim 1, wherein the second chamber wall comprises a second chamber perimeter with a non-circular profile when the second chamber is viewed in cross-section, the non-circular profile of the second chamber allowing a volume of the second chamber to change without changing a length of the second chamber perimeter.

8. The apparatus as claimed in claim 7, wherein the second chamber perimeter comprises a wave shaped profile.

9. The apparatus as claimed in claim 1, wherein the second flexible diaphragm comprises an annular seal member configured to engage in sealing manner with a radially inner member in order to seal between the second chamber and a region outside of the second chamber, wherein the annular seal member comprises a first annularly and axially extending portion configured to engage the radially inner member and to extend axially along the radially inner member inwardly into the second chamber, the first portion being exposed to pressure in the second chamber, and wherein a second annularly and axially extending portion is configured to engage the radially inner member and to extend axially along the radially inner member away from the second chamber, the second portion being exposed to pressure in the region outside the second chamber.

10. The apparatus as claimed in claim 1, further comprising:

a third flexible diaphragm defining a wall of the third chamber, wherein the third flexible diaphragm comprises an outer surface exposed to external ambient pressure.

11. The apparatus as claimed in claim 10, wherein the third chamber wall comprises a third chamber perimeter with a non-circular profile when the third chamber is viewed in cross-section, the non-circular profile of the third chamber allowing a volume of the third chamber to change without changing a length of the third chamber perimeter.

12. The apparatus as claimed in claim 11, wherein the third chamber perimeter comprises a wave shaped profile.

13. A cable termination assembly comprising:

an underwater connecting apparatus comprising:

a first flexible diaphragm defining a wall of a first chamber for receiving therein an electrical conductor and for containing an electrically insulating material around the electrical conductor; and a second flexible diaphragm defining a wall of a second chamber, wherein the first flexible diaphragm comprises an electrically conductive material and an outer surface exposed to pressure in the second chamber, and wherein the second flexible diaphragm is exposed to pressure in a third chamber; and a cable that extends into the first chamber.

14. An assembly as claimed in claim 13, wherein the first flexible diaphragm engages a conductive screen of the cable.

15. An assembly as claimed in claim 13, wherein the underwater connecting apparatus further comprises:

a third flexible diaphragm defining a wall of the third chamber, wherein the third flexible diaphragm comprises an outer surface exposed to external ambient pressure.

16. An assembly as claimed in claim 15, wherein the third chamber wall comprises a third chamber perimeter with a non-circular profile when the third chamber is viewed in cross-section, the non-circular profile of the third chamber allowing a volume of the third chamber to change without changing a length of the third chamber perimeter.

* * * * *